US007601071B2

(12) United States Patent
Costain

(10) Patent No.: US 7,601,071 B2
(45) Date of Patent: Oct. 13, 2009

(54) CUE STICK JOINT

(76) Inventor: Paul D. Costain, 2734 Huntington Hills Dr., Lakeland, FL (US) 33810

( * ) Notice: Subject to any disclaimer, the term of this patent is extended or adjusted under 35 U.S.C. 154(b) by 0 days.

(21) Appl. No.: 11/935,875

(22) Filed: Nov. 6, 2007

(65) Prior Publication Data

US 2008/0119297 A1 May 22, 2008

Related U.S. Application Data

(63) Continuation-in-part of application No. 11/409,509, filed on Apr. 21, 2006.

(60) Provisional application No. 60/936,436, filed on Jun. 20, 2007.

(51) Int. Cl.
*A63D 15/08* (2006.01)

(52) U.S. Cl. ..... 473/44

(58) Field of Classification Search ..... 473/44–49, 473/288, 296; 411/374, 429; 403/23, 292, 403/296, 297, 306, 307, 314; 138/96
See application file for complete search history.

(56) References Cited

U.S. PATENT DOCUMENTS

| | | | |
|---|---|---|---|
| 122,218 | A | 12/1871 | Bogart |
| 248,681 | A | 10/1881 | Walter |
| 664,528 | A | 12/1900 | Brauers |
| 682,677 | A | 9/1901 | Ferchland |
| 812,309 | A | 2/1906 | Swagerty |
| 965,131 | A | 7/1910 | Bliss |
| 970,172 | A | 9/1910 | Bloom et al. |
| 1,147,705 | A | 7/1915 | Campbell |
| 1,527,748 | A | 2/1925 | Rambow |
| 1,527,853 | A | 2/1925 | Ferdon |
| 1,609,026 | A | 11/1926 | Lindley |
| 1,679,073 | A | 7/1928 | Carmichael |
| 1,705,353 | A | 3/1929 | Barrett |
| 2,227,735 | A | 1/1941 | Morton |
| 3,170,691 | A | 2/1965 | Pritchard |
| 3,232,613 | A | 2/1966 | Laube, Jr. |
| 3,312,139 | A | 4/1967 | DiCristina |
| 3,334,901 | A | 8/1967 | Steffes |
| 3,368,271 | A | 2/1968 | Scheffler |
| 3,436,079 | A | 4/1969 | Berry et al. |

(Continued)

FOREIGN PATENT DOCUMENTS

| | | |
|---|---|---|
| CA | 726578 | 1/1966 |

(Continued)

OTHER PUBLICATIONS

Drawing of coupling rod manufactured by Bender Cues for securing to one stick portion of a cue stick (Jul. 13, 1992).

(Continued)

*Primary Examiner*—Mark S Graham
(74) *Attorney, Agent, or Firm*—Hamilton, Brook, Smith & Reynolds, P.C.

(57) ABSTRACT

A sports stick portion includes a pin secured to a stick portion. The pin can have a male threaded region for engaging a mating stick portion and a distal end. A collar can concentrically surround the male threaded region and the distal end of the pin.

8 Claims, 8 Drawing Sheets

U.S. PATENT DOCUMENTS

| | | | |
|---|---|---|---|
| 3,462,147 | A | 8/1969 | Mancuso |
| 3,848,737 | A | 11/1974 | Kenon |
| 4,231,574 | A | 11/1980 | Williams |
| 4,314,575 | A | 2/1982 | Kuo |
| 4,340,227 | A | 7/1982 | Dopkowski |
| 4,440,391 | A | 4/1984 | Saenz, Jr. |
| 4,565,392 | A | 1/1986 | Vyse |
| 4,577,990 | A | 3/1986 | Carlson |
| 4,630,958 | A | 12/1986 | McCallister |
| 4,645,245 | A | 2/1987 | Cunningham |
| 4,718,671 | A | 1/1988 | Desmond et al. |
| 4,797,021 | A | 1/1989 | Stamper |
| 4,858,926 | A | 8/1989 | Cabianca |
| 4,943,333 | A | 7/1990 | Chang |
| 5,062,636 | A | 11/1991 | Rahn |
| 5,112,046 | A | 5/1992 | Thorpe |
| 5,193,929 | A | 3/1993 | Kahn |
| 5,290,030 | A | 3/1994 | Medbury |
| 5,334,101 | A | 8/1994 | McDermott |
| 5,407,197 | A | 4/1995 | Parsons |
| 5,514,039 | A | 5/1996 | Gendron et al. |
| 5,518,455 | A | 5/1996 | Costain et al. |
| 5,527,224 | A | 6/1996 | Costain et al. |
| 5,643,095 | A | 7/1997 | Probst |
| 5,678,944 | A | 10/1997 | Slocum et al. |
| 5,820,473 | A | 10/1998 | Lambros |
| 5,857,923 | A | 1/1999 | Veller |
| 5,890,966 | A | 4/1999 | Costain et al. |
| 5,927,894 | A | 7/1999 | Zavaglia |
| 5,997,412 | A | 12/1999 | Benson |
| 6,027,410 | A | 2/2000 | Costain et al. |
| 6,050,903 | A | 4/2000 | Lake |
| 6,056,472 | A | 5/2000 | Latulippe et al. |
| 6,132,321 | A | 10/2000 | Wethered |
| 6,164,188 | A | 12/2000 | Miser |
| 6,165,078 | A | 12/2000 | Holt |
| 6,227,980 | B1 | 5/2001 | Costain et al. |
| 6,348,006 | B2 | 2/2002 | Costain et al. |
| 6,371,865 | B1 | 4/2002 | Magliulo |
| 6,398,660 | B1 | 6/2002 | Probst et al. |
| 6,447,404 | B1 | 9/2002 | Wilbur |
| 6,582,317 | B2 | 6/2003 | Pechauer et al. |
| 6,638,178 | B2 | 10/2003 | Tseng |
| 6,712,712 | B2 | 3/2004 | Bourque |
| 6,764,413 | B2 | 7/2004 | Ho |
| 6,783,462 | B1 | 8/2004 | Costain |
| 7,241,226 | B2 | 7/2007 | Costain et al. |
| 2001/0008854 | A1 | 7/2001 | Costain et al. |
| 2001/0051547 | A1 | 12/2001 | Takahira |
| 2003/0039508 | A1 | 2/2003 | Barbosa |
| 2003/0050129 | A1 | 3/2003 | Kuo |
| 2003/0096656 | A1 * | 5/2003 | Pechauer et al. ..... 473/44 |
| 2003/0166419 | A1 | 9/2003 | Gulyassy |
| 2003/0235461 | A1 | 12/2003 | Hsu |
| 2005/0043107 | A1 | 2/2005 | Kuo |
| 2006/0089203 | A1 * | 4/2006 | Costain et al. ..... 473/44 |
| 2007/0060406 | A1 | 3/2007 | Miki |

FOREIGN PATENT DOCUMENTS

| | | | |
|---|---|---|---|
| EP | 0 465 202 | A1 | 1/1992 |
| GB | 000008849 | A | 0/1885 |
| GB | 2 096 470 | A | 10/1982 |
| GB | 2 191 707 | A | 12/1987 |
| GB | 2 192 800 | A | 1/1988 |
| GB | 2 199 505 | A | 7/1988 |
| GB | 2 209 681 | A | 5/1989 |
| GB | 2 219 946 | A | 12/1989 |
| GB | 2 222 091 | A | 2/1990 |
| GB | 2 226 251 | A | 6/1990 |
| GB | 2 246 302 | A | 1/1992 |
| GB | 2 268 082 | A | 1/1994 |
| GB | 2 279 017 | A | 12/1994 |
| JP | 8-117388 | | 5/1996 |

OTHER PUBLICATIONS

Drawing of a prior art cue stick portion having a coupling rod and joint collar (at least by 1985).

Drawing depicting a coupling joint which engages in three revolutions. The smooth elongate tip extending from the external threaded region is not in a close fit with the bore extending from the internal threaded region upon engaging the two threaded regions.

Drawing depicting a coupling joint which has an external threaded region characterized by a significant number of threads. The internal threaded region is characterized by two threads. Extending from the internal threaded region is a smooth bore for receiving the external threaded region. The coupling joint engages in a significant number of revolutions.

* cited by examiner

CUE STICK JOINT

RELATED APPLICATIONS

This is a continuation-in-part application of U.S. application Ser. No. 11/409,509, filed Apr. 21, 2006, and claims the benefit of U.S. Provisional Application No. 60/936,436, filed on Jun. 20, 2007. The entire teachings of the above applications are incorporated herein by reference.

BACKGROUND

Cue sticks for playing pool can have two or more tapered stick portions which can be assembled together for use and disassembled for storage. Typically, the mating ends of the stick portions that become joined together include joint members which engage each other for securing the stick portions together. Manufacturers can have great difficulty accurately installing joint members in the stick portions. Current inspection techniques and equipment are typically insufficient for assuring proper positioning of the joint members in tapering stick portions. Concentricity and/or run out and perpendicularity are difficult dimensions to maintain with processes and procedures known in the art. Misalignment of the joint members in their respective stick portions can cause misalignment of the stick portions when assembled. Misalignment of the stick portions can adversely affect the performance of the cue stick during use.

SUMMARY

The present invention can provide a joint for a cue stick which can secure stick portions of a cue stick together in alignment with each other when there is misalignment of joint members in the stick portions. The joint can have adequate concentricity and can allow the faces of the stick portions to come together without requiring strict tolerances of perpendicularity of the joint members in the stick portions.

The present invention can provide a joint for a cue stick where the cue stick has at least first and second cue stick portions. The joint can include a first joint member for securing to the first stick portion. The first joint member can have a joint securing male threaded region and a locating tip at a distal end. A second joint member can be included for securing to the second stick portion. The second joint member can have a bore for receiving the locating tip, and a joint securing female threaded region for engaging the joint securing male threaded region of the first joint member for coupling the first and second joint members together. The locating tip can have a pivot structure that is configured to engage the bore and pivot against the bore such that the first joint member is capable of pivoting about the pivot structure to compensate for misalignment of the first and second joint members.

In particular embodiments, the pivot structure of the locating tip can have a close fit with the bore. The bore can have a constant diameter portion for receiving and engaging the pivot structure of the locating tip. The pivot structure can have a pivot surface that is shaped for pivoting within the constant diameter portion of the bore. The pivot structure can have a narrow annular region of engagement with the bore within the constant diameter portion. The locating tip can include a generally curved portion.

In one embodiment, the locating tip can include a generally spherical portion at the end. In another embodiment, the locating tip can include a generally bullet shaped portion. In yet another embodiment, the locating tip can include a generally rounded portion that extends from a constant diameter portion.

In other embodiments, the locating tip can include a generally tapered portion. In one embodiment, the generally tapered portion of the locating tip can include a flat end. In another embodiment, the generally tapered portion of the locating tip can include a pointed end. In a different embodiment, the locating tip can include a generally disc shaped portion.

The first and second joint members can be capable of engaging together within about four turns relative to each other. In some embodiments, the first and second joint members can be capable of engaging together within about one turn relative to each other. The first joint member can further include a collar encircling the male threaded region. The first and second joint members can include secondary male threaded regions for securing the first and second joint members to respective first and second stick portions. The first and second joint members can each include a smooth outer diameter region adjacent to the secondary male threaded region.

The present invention can also provide a cue stick including a first cue stick portion and a first joint member secured to the first stick portion. The first joint member can include a joint securing male threaded region and a locating tip at a distal end. The cue stick can include a second cue stick portion and a second joint member secured to the second stick portion. The second joint member can have a bore for receiving the locating tip, and a joint securing female threaded region for engaging the joint securing male threaded region of the first joint member for coupling the first and second joint members together. The locating tip can have a pivot structure that is configured to engage the bore and pivot against the bore such that the first joint member is capable of pivoting about the pivot structure to compensate for misalignment of the first and second joint members.

In particular embodiments, the first and second joint members can include features such as previously discussed above.

The present invention can also provide a joint for a sports stick, where the sports stick can have first and second sports stick portions. The joint can include a first joint member for securing to the first stick portion. The first joint member can include a joint securing male threaded region and a locating tip at a distal end. A second joint member can be included for securing to the second stick portion. The second joint member can have a bore for receiving the locating tip, and a joint securing female threaded region for engaging the joint securing male threaded region of the first joint member for coupling the first and second joint members together. The locating tip can have a pivot structure that is configured to engage the bore and pivot against the bore such that the first joint member is capable of pivoting about the pivot structure to compensate for misalignment of the first and second joint members.

In particular embodiments, the first and second joint members can include features such as previously described above.

The present invention can also provide a sports stick including a first sports stick portion and a first joint member secured to the first stick portion. The first joint member can include a joint securing male threaded region and a locating tip at a distal end. The sports stick can include a second sports stick portion and a second joint member secured to the second stick portion. The second joint member can have a bore for receiving the locating tip, and a joint securing female threaded region for engaging the joint securing male threaded region of the first joint member for coupling the first and second joint members together. The locating tip can have a pivot structure that is configured to engage the bore and pivot against the bore such that the first joint member is capable of pivoting about the pivot structure to compensate for misalignment of the first and second joint members.

In particular embodiments, the first and second joint members can include features such as previously described above.

The present invention can also provide a method of securing a joint for a cue stick, where the cue stick can have first and second cue stick portions. A first joint member can be provided for securing to the first stick portion. The first joint member can include a joint securing male threaded region and a locating tip at a distal end. A second joint member can be provided for securing to the second stick portion. The second joint member can have a bore and a joint securing female threaded region. The locating tip of the first joint member can be engaged with the bore of the second joint member. The joint securing male threaded region of the first joint member can be engaged with the joint securing female threaded region of the second joint member for coupling the first and second joint members together. A pivot structure of the locating tip can be engaged with the bore. The pivot structure can be configured for pivoting against the bore such that the first joint member is capable of pivoting about the pivot structure to compensate for misalignment of the first and second joint members.

In particular embodiments, the first and second joint members can include features such as previously described above.

The present invention can also provide a method of securing a cue stick together, where the cue stick can have first and second cue stick portions. A first joint member can be provided with the first stick portion. The first joint member can include a joint securing male threaded region and a locating tip at a distal end. A second joint member can be provided with the second stick portion. The second joint member can have a bore and a joint securing female threaded region. The locating lip of the first joint member can be engaged with the bore of the second joint member. The joint securing male threaded region of the first joint member can be engaged with the joint securing female threaded region of the second joint member for coupling the first and second joint members together. The pivot structure of the locating tip can be engaged with the bore. The pivot structure can be configured for pivoting against the bore such that the first joint member is capable of pivoting about the pivot structure to compensate for misalignment of the first and second joint members.

In particular embodiments, the first and second joint members can include features such as previously described above.

The present invention can also provide a method of securing a joint for a sports stick, where the sports stick can have first and second sports stick portions. A first joint member can be provided for securing to the first stick portion. The first joint member can include a joint securing male threaded region and a locating tip at a distal end. A second joint member can be provided for securing to the second stick portion. The second joint member can have a bore and a joint securing female threaded region. The locating tip of the first joint member can be engaged with the bore of the second joint member. The joint securing male threaded region of the first joint member can be engaged with the joint securing female threaded region of the second joint member for coupling and first and second joint members together. A pivot structure of the locating tip can be engaged with the bore. The pivot structure can be configured for pivoting against the bore such that the first joint member is capable of pivoting about the pivot structure to compensate for misalignment of the first and second joint members.

In particular embodiments, the first and second joint members can include features such as previously discussed above.

The present invention can also provide a method of securing a sports stick together, where the sports stick can have first and second sports stick portions. A first joint member can be provided with the first stick portion. The first joint member can include a joint securing male threaded region and a locating tip at a distal end. A second joint member can be provided with the second stick portion. The second joint member can have a bore and a joint securing female threaded region. The locating tip of the first joint member can be engaged with the bore of the second joint member. The joint securing male threaded region of the first joint member can be engaged with the joint securing female threaded region of the second joint member for coupling the first and second joint members together. A pivot structure of the locating tip can be engaged with the bore. The pivot structure can be configured for pivoting against the bore such that the first joint member is capable of pivoting about the pivot structure to compensate for misalignment of the first and second joint members.

In particular embodiments, the first and second joint members can include features such as previously discussed above.

The present invention can also provide a sports stick portion including a pin secured to a stick portion. The pin can have a male threaded region for engaging a mating stick portion and a distal end. A collar can concentrically surround the male threaded region and the distal end of the pin.

In particular embodiments, the pin can be hidden within the collar when viewed from the side. The sports stick portion can be a cue stick portion. The distal end of the pin can be generally flush with a distal end of the collar. The distal end of the pin can include a pivot structure extending from the male threaded region. The pivot structure can include a smooth diameter having a short axial length spaced apart from the male threaded region by a narrowed neck, forming an annular pivot structure. The collar can form an annular recess around the pin. In some embodiments, the collar can have a bore with a pivot structure extending radially inwardly.

The present invention can also provide a joint for a sports stick. The joint can include a first joint member having a pin with a joint securing male threaded region and a distal end, and a collar concentrically surrounding the male threaded region and the distal end of the pin. A second joint member can be included and can be configured and have a hole for receiving the pin. The hole can have a joint securing female threaded region for engaging the joint securing male threaded region of the first joint member for coupling the first and second joint members together.

In particular embodiments, the pin can be hidden within the collar when viewed from the side. The sports stick can be a cue stick. The distal end of the pin can be generally flush with a distal end of the collar. The first joint member can include an annular recess between the pin and the collar. The second joint member can have a protruding head that is insertable within the annular recess of the first joint member. The distal end of the pin can include a pivot structure extending from the male threaded region. The hole of the second joint member can include a bore for receiving the pivot structure. The pivot structure can be configured to engage the bore and pivot against the bore such that the first joint member is capable of pivoting about the pivot structure to compensate for misalignment of the first and joint members. The pivot structure can have a close fit with the bore. The pivot structure can have a pivot surface that is shaped for pivoting within a constant diameter portion of the bore. The pivot structure can have a narrow annular region of engagement with the bore within the constant diameter portion. The first and second joint members can be capable of engaging together within about four turns relative to each other. In some embodiments, the first and second joint members are capable of engaging together within about one turn relative to each other. In some embodiments, the collar can have a bore with a pivot structure extending radially inwardly to allow pivoting of the joint members to compensate for misalignment. In other embodiments, the second joint member can include a head having a pivot structure for engaging a bore of the collar for allowing pivoting of the joint members to compensate for misalignment.

The present invention can also provide a sports stick including a first stick portion with a first joint member secured to the first stick portion. The first joint member can include a pin with a joint securing male threaded region and a distal end, and a collar concentrically surrounding the male threaded region and the distal end of the pin. A second stick portion can be included with a second joint member secured to the second stick portion. The second joint member can be configured and have a hole for receiving the pin. The hole can have a joint securing female threaded region for engaging the joint securing male threaded region of the first joint member for coupling the first and second joint members together.

In particular embodiments, the pin can be hidden within the collar when viewed from the side. The sports stick can be a cue stick having first and second cue stick portions.

The present invention can also provide a joint for a sports stick. The joint can include a first joint member having a pin with a joint securing male threaded region, and a collar having a bore concentrically surrounding at least a portion of the male threaded region. A second joint member can be included and can be configured and have a hole for receiving the pin. The hole can have a joint securing female threaded region for engaging the joint securing male threaded region of the first joint member for coupling the first and second joint members together. The second joint member can have a head for engaging the bore of the collar. One of the bore and the head can have a pivot structure for allowing pivoting of the joint members to compensate for misalignment.

In particular embodiments, the sports stick can be a cue stick.

The present invention can also provide a sports stick including a first stick portion with a first joint member secured to the first stick portion. The first joint member can include a pin with a joint securing male threaded region, and a collar having a bore concentrically surrounding at least a portion of the male threaded region. A second stick portion can be included with a second joint member secured to the second stick portion. The second joint member can be configured and have a hole for receiving the pin. The hole can have a joint securing female threaded region for engaging the joint securing male threaded region of the first joint member for coupling the first and second joint members together. The second joint member can have a head for engaging the bore of the collar. One of the bore and the head can have a pivot structure for allowing pivoting of the joint members to compensate for misalignment.

In particular embodiments, the sports stick can be a cue stick with first and second cue stick portions.

The present invention can also provide a method of forming a sports stick portion including securing a pin to a stick portion. The pin can have a male threaded region for engaging a mating stick portion and a distal end. A collar can concentrically surround the male threaded region and the distal end of the pin.

In particular embodiments, the pin can be hidden within the collar when viewed from the side. The sports stick portion can be a cue stick portion. The distal end of the pin can be generally flush with a distal end of the collar. A pivot structure can extend from the male threaded region. The pivot structure can have a smooth diameter with a short axial length spaced apart from the male threaded region by a narrowed neck, forming an annular pivot structure. An annular recess can be formed around the pin with the collar. In some embodiments, the collar can have a bore with a pivot structure extending radially inwardly.

The present invention can also provide a method of securing a joint for a sports stick. A first joint member can be provided which can include a pin with a joint securing male threaded region and a distal end, and a collar concentrically surrounding the male threaded region and the distal end of the pin. A second joint member can be provided which can have a hole for receiving the pin. The hole can have a joint securing female threaded region. The first and second joint members can be coupled together with the second joint member being configured to allow the hole of the second joint member to engage the pin of the first joint member and engage the joint securing male threaded region with the joint securing female threaded region.

In particular embodiments, the pin can be hidden within the collar when viewed from the side. The joint can be for a cue stick. The distal end of the pin can be generally flush with a distal end of the collar. The first joint member can include an annular recess between the pin and the collar. A protruding head of the second joint member can be inserted into the annular recess of the first joint member. A pivot structure can extend from the male threaded region of the first joint member. The pivot structure can be received within a bore included in the hole of the second joint member. The pivot structure can be configured to engage the bore and pivot against the bore such that the first joint member is capable of pivoting about the pivot structure to compensate for misalignment of the first and second joint members. The pivot structure can have a close fit with the bore. The pivot structure can have a pivot surface that is shaped for pivoting within a constant diameter portion of the bore. The pivot structure can be engaged with the bore within the constant diameter portion along a narrow annular region of engagement. The first and second joint members can engage together within about four turns relative to each other. In some embodiments, the first and second joint members can engage together within about one turn relative to each other. In some embodiments, the collar can have a bore with a pivot structure extending radially inwardly to allow pivoting of the joint members to compensate for misalignment. In other embodiments, the second joint member can include a head having a pivot structure for engaging a bore of the collar for allowing pivoting of the joint members to compensate for misalignment.

The present invention can also provide a method of securing a sports stick together. The sports stick can have first and second sports stick portions. The first stick portion can be provided with a first joint member. The first joint member can include a pin with a joint securing male threaded region and a distal end, and a collar concentrically surrounding the male threaded region and the distal end of the pin. The second stick portion can be provided with a second joint member. The second joint member can have a hole for receiving the pin. The hole can have a joint securing female threaded region. The first and second joint members can be coupled together with the second joint member being configured to allow the hole of the second joint member to engage the pin of the first joint member and engage the joint securing male threaded region with the joint securing female threaded region.

In particular embodiments, the pin can be hidden within the collar when viewed from the side. The sports stick can be a cue stick with first and second cue stick portions.

The present invention can also provide a method of securing a joint for a sports stick. A first joint member can be provided which can include a pin with a joint securing male threaded region, and a collar having a bore concentrically surrounding at least a portion of the male threaded region. A second joint member can be provided which can have a hole for receiving the pin. The hole can have a joint securing female threaded region. The first and second joint members can be coupled together with the second joint member being configured to allow the hole of the second joint member to engage the pin of the first joint member and engage the joint securing male threaded region with the joint securing female threaded region. The second joint member can have a head for engaging the bore of the collar. One of the bore and the head can have a pivot structure for allowing pivoting of the joint members to compensate for misalignment.

In particular embodiments, the sports stick can be a cue stick.

The present invention can also provide a method of securing a sports stick together. The sports stick can have first and second sports stick portions. The first stick portion can be provided with a first joint member. The first joint member can include a pin with a joint securing male threaded region, and a collar having a bore concentrically surrounding at least a portion of the male threaded region. The second stick portion can be provided with a second joint member. The second joint member can have a hole for receiving the pin. The hole can have a joint securing female threaded region. The first and second joint members can be coupled together with the second joint member being configured to allow the hole of the second joint member to engage the pin of the first joint member and engage the joint securing male threaded region with the joint securing female threaded region. The second joint member can have a head for engaging the bore of the collar. One of the bore and the head can have a pivot structure for allowing pivoting of the joint members to compensate for misalignment.

In particular embodiments, the sports stick can be a cue stick with first and second cue stick portions.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 2:
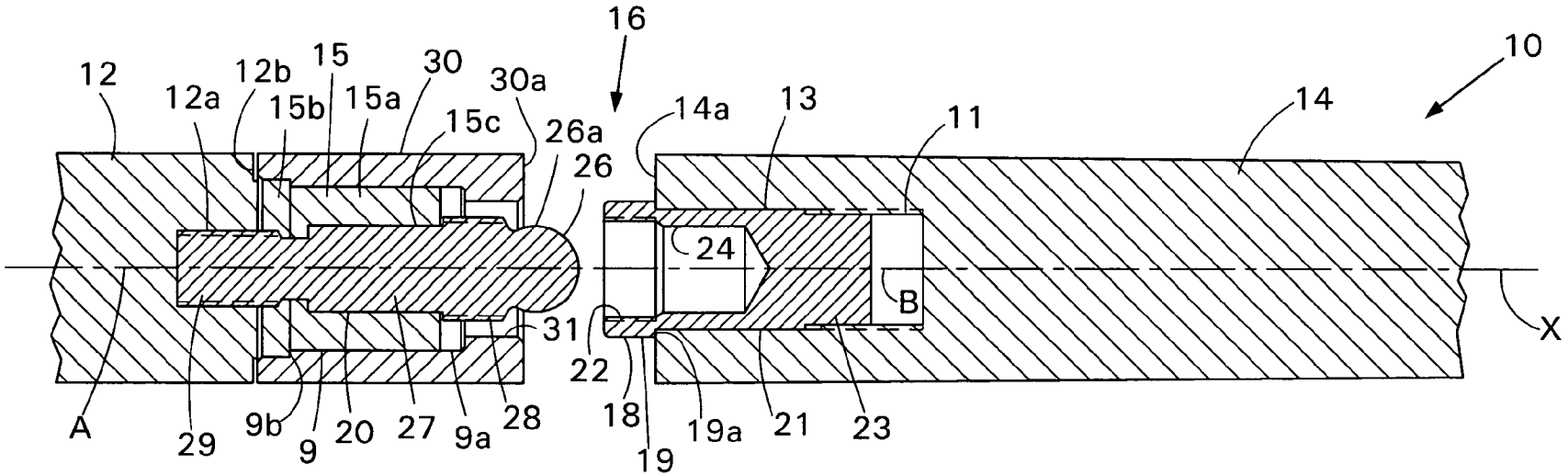
FIG. 2 is a sectional view of FIG. 1.
Figure 1:
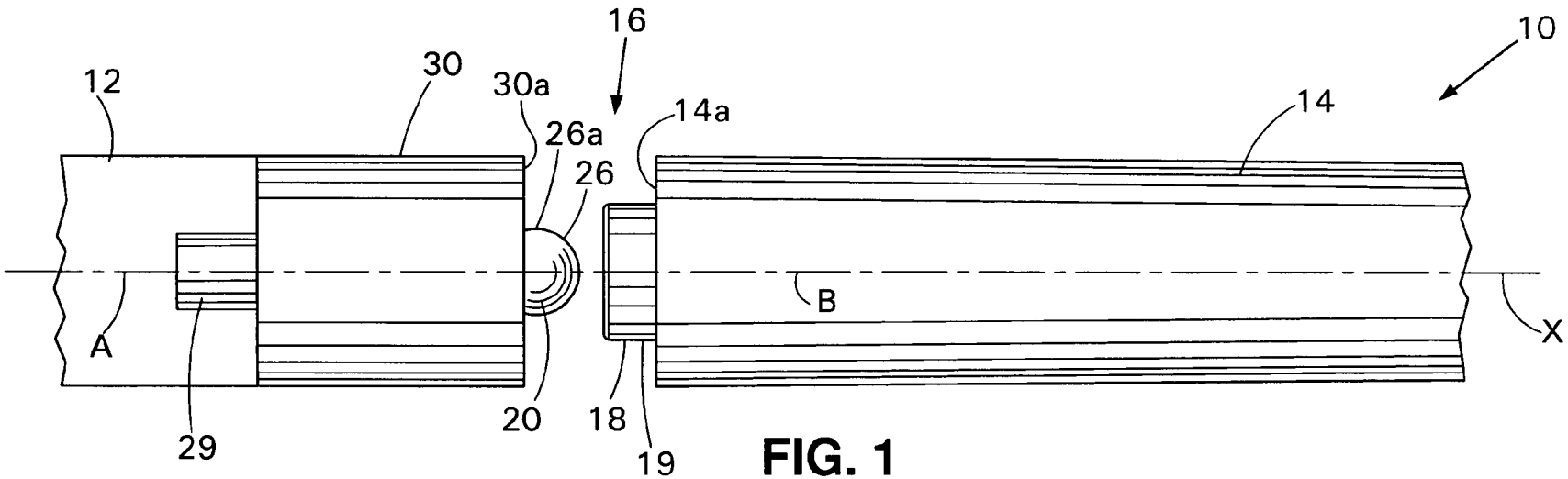
FIG. 1 is a side view of two stick portions incorporating an embodiment of a joint in the present invention.

FIGS. 1 and 2 depict two stick portions 12 and 14 of a sports stick, for example, a cue stick 10, which can be coupled together by a joint 16. The cue stick 10 can extend along a longitudinal axis X and include a first stick portion 12 that can form the butt, and a second stick portion 14 that can form the shaft or tip, or vice versa. A coupling rod, pin or first joint member 20 having a longitudinal axis A (FIG. 3), can be secured to the first stick portion 12, and an insert sleeve or second joint member 18 having a longitudinal axis B (FIG. 4), can be secured to the second stick portion 14. The coupling rod 20 can include a centering or locating pin or tip 26 at the distal end, and a joint securing male threaded portion or region 28. The coupling rod 20 can be secured within a hole 12*a* at the end of the stick portion 12 with a secondary male threaded portion or region 29. The locating tip 26 can include a pivot structure 26*a* having pivot surfaces A generally cylindrical collar 30 can be positioned at the end 12*b* of stick portion 12 and encircle the male threaded region 28 for protecting the male threaded region 28. The collar 30 can be centered and positioned relative to the coupling rod 20 by a bushing 15 therebetween. The sleeve 18 can include a receiving cavity having a joint securing female threaded portion or region 22 and a bore 24. The sleeve 18 can be secured to stick portion 14 within a hole 13 by a secondary male threaded portion or region 23.

The male threaded region 28 of the coupling rod 20 can engage the female threaded region 22 of the sleeve 18 for securing stick portion 12 to stick portion 14. The locating tip 26 of the coupling rod 20 can closely engage the bore 24 for aligning the coupling rod 20 and stick portion 12 with the sleeve 18 and stick portion 14. The pivot structure 26*a* on the locating lip 26 of the coupling rod 20 can allow pivoting of the locating tip 26 within the bore 24 of the sleeve 18 when the coupling rod 20 and sleeve 18 are being secured together so that the coupling rod 20 and the sleeve 18 can be secured together in slight axial misalignment. This can allow the stick portions 12 and 14 to be assembled together in axial alignment along the longitudinal axis X of cue stick 10 when one or both of the coupling rod 20 and sleeve 18 are mounted in axial misalignment with their respective stick portions 12 and 14.

Figure 3:
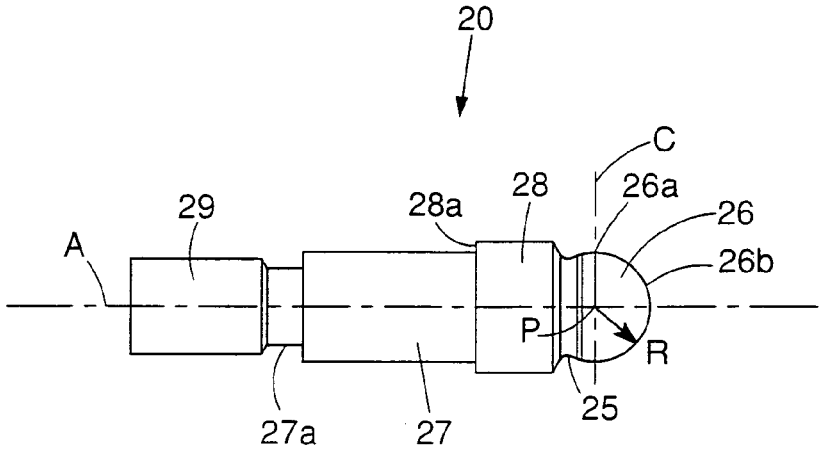
FIG. 3 is a side view of an embodiment of a first joint member or coupling rod.

In one embodiment, referring to FIG. 3, the locating tip 26 of the coupling rod 20 can be located at the distal end of coupling rod 20 and extend along the longitudinal axis A of the coupling rod 20. The locating tip 26 can have a generally spherical portion 26*b* that extends from the male threaded region 28 and can be connected to the male threaded region 28 by a neck 25. As a result, the generally spherical portion 26*b* can be a partial spheres for example, about ¾ of a sphere, depending upon the diameter of the neck 25.

The pivot structure 26*a* can include the rounded or curved surfaces of the generally spherical portion 26*b* which allow the locating tip 26 and the coupling rod 20 to pivot about a pivot point center P. These rounded or curved surfaces can be on and near the lateral axis C of coupling rod 20 which passes through the pivot point P perpendicular to the longitudinal axis A of the coupling rod 20. The spherical portion 26*b* can have a radius R extending or centered from pivot point P. Since the generally spherical portion 26*b* can have a constant radius R at regions on and near the lateral axis C, the engagement diameter of the pivot structure 26*a* with the bore 24 of the sleeve 18 can remain constant with pivoting of the locating tip 26. The engagement of the pivot structure 26*a* with the bore 24 can be a narrow annular band or line of contact or engagement. The actual location of the annular contact or engagement on the generally spherical portion 26*b* can change with pivoting. The curved surface of the generally spherical portion 26*b* at the pivot structure 26*a* can promote and allow pivoting or rotation of the locating tip 26 within and against the bore 24.

The male threaded region 28 can have a thread pitch and length sufficient to provide engagement with the female threaded region 22 of the sleeve 18 in about one turn or revolution. In some embodiments, engagement can occur in multiple revolutions, for example, about 7 revolutions. A typical number of multiple turns can be about 2-4 turns. Although 4 or less turns is desirable, various numbers of turns can be used, depending upon the situation at hand.

A smooth outer diameter portion or region 27 with a constant diameter can be connected and adjacent to male threaded region 28 for centering the coupling rod 20 within bushing 15. A secondary male threaded region 29 can extend from the smooth outer diameter region 27 and can be separated from the smooth outer diameter region 27 by a neck 27*a*. The smooth outer diameter region 27 can have spiraling glue groove on the outer surface.

In one embodiment, the coupling rod 20 can be formed of metal, such as steel, but can be formed of other suitable methods, such as polymers and composites. The coupling rod can be about 1.5 inches long. The generally spherical portion 26*b* of the locating tip 26 can have a diameter of about 0.32 inches (radius R of 0.16 inches) and can extend about 0.32 inches from the male threaded region 28. The male threaded region 28 can have a ⅜-11 thread, with truncated threads about 0.18 to 0.22 inches long. The smooth outer diameter portion 27, and can be about 0.31 inches in diameter and about 0.5 inches long. The secondary threaded region 29 can be a 5/16-14 thread and extend from the smooth outer diameter region 27 about 0.5 inches.

In order to position the collar 30 about coupling rod 20, the smooth outer diameter region 27 of coupling rod 20 can be first inserted into a hole 15*c* within bushing 15 until the shoulder 28*a* of male threaded region 28 engages the outer face of the bushing 15 and is secured therein (FIG. 2). The bushing 15 can then be inserted and secured within cavity 9 in the collar 30 for concentrically and axially positioning the collar 30 around the male threaded region 28. The bushing 15 can have a first portion 15*a* for engaging bore portion 9*a* of the cavity 9, and a flange 15*b* for engaging shoulder 9*b*. This can position collar 30 relative to coupling rod 20 to form an annular recess 31 surrounding the male threaded region 28 of the coupling rod 20. The coupling rod 20, bushing 15 and collar 30 can be preassembied as a coupling rod/collar assembly. When the secondary male threaded region 29 of the coupling rod 20 is engaged within hole 12*a* of the stick portion 12, the shoulder 28*a* can tighten the bushing 15 and collar 30 against the end 12*b* of stick portion 12. Consequently, when the stick portions 12 and 14 of cue stick 10 are assembled during use, the face 30*a* of the collar 30 can engage and become tightened against the face 14*a* of stick portion 14. In some embodiments, the smooth outer diameter region 27 can be mounted within a hole in the stick portion 12. In some instances, the collar 30 can be omitted.

Figure 4:
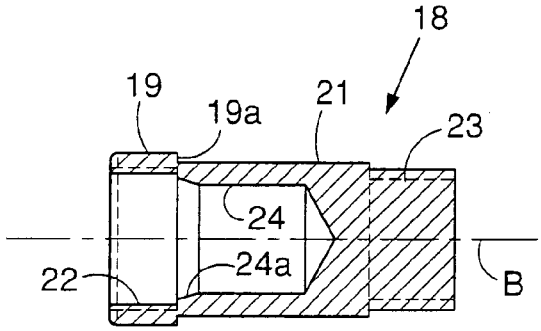
FIG. 4 is a side sectional view of an embodiment of a second joint member or sleeve.

In one embodiment, referring to FIG. 4, the sleeve 18 can have a female threaded region 22 having a length extending along the longitudinal axis B of the sleeve 18 which generally corresponds to the length of the male threaded region 28 of the coupling rod 20. The major, minor, and/or pitch diameters of the female threaded region 22 can be formed with enough clearance relative to the male threaded region 28 of the coupling rod 20 so that the male threaded region 28 can move slightly laterally or perpendicular to relative to the longitudinal axis B of the sleeve 18. The bore 24 can have a tapered entrance 24*a* transitioning from the female threaded region 22. The bore 24 can have a smooth constant inner diameter portion and can be sized to have a close fit with the locating tip 26 of the coupling rod 20. A smooth outer diameter portion or region 21 can engage hole 13 for centering the sleeve 18 within stick portion 14. The secondary male threaded portion or region 23 can extend from the smooth outer diameter region 21 for engaging the bottom portion or region 11 of the hole 13 to secure the sleeve 18 within hole 13. The sleeve 18 can have a head 19 with a shoulder 19*a* which can engage the face 14*a* of stick portion 14 so that the head 19 can protrude from the face 14*a*. The female threaded region 22 can be positioned within the head 19. As a result, the head 19 can be inserted into the recess 31 between collar 30 and the male threaded region 28 of the coupling rod 20 so that the threaded regions 28 and 22 can engage each other.

In one embodiment, the sleeve 18 can be made of a metal, such as brass or bronze. Alternatively, the sleeve can be made of other suitable materials, such as polymers, composites, etc. The female threaded region 22 can have a ⅜-11 thread, with truncated threads, and can be about 0.16 inches long. The bore 24 can have a diameter of about 0.3215 inches, so that there can be about 0.0015 inches clearance between the locating tip 26 and pivot structure 26*a* of the coupling rod 20 and the bore 24. The secondary male threaded region 23 can have a 7/16-14 thread and can be about 0.25 inches long. The smooth outer diameter portion 21 can have a diameter of about 0.4460 inches, and can include a spiraling glue groove. The head 19 can have an outer diameter of about 0.5 inches.

Figure 5:
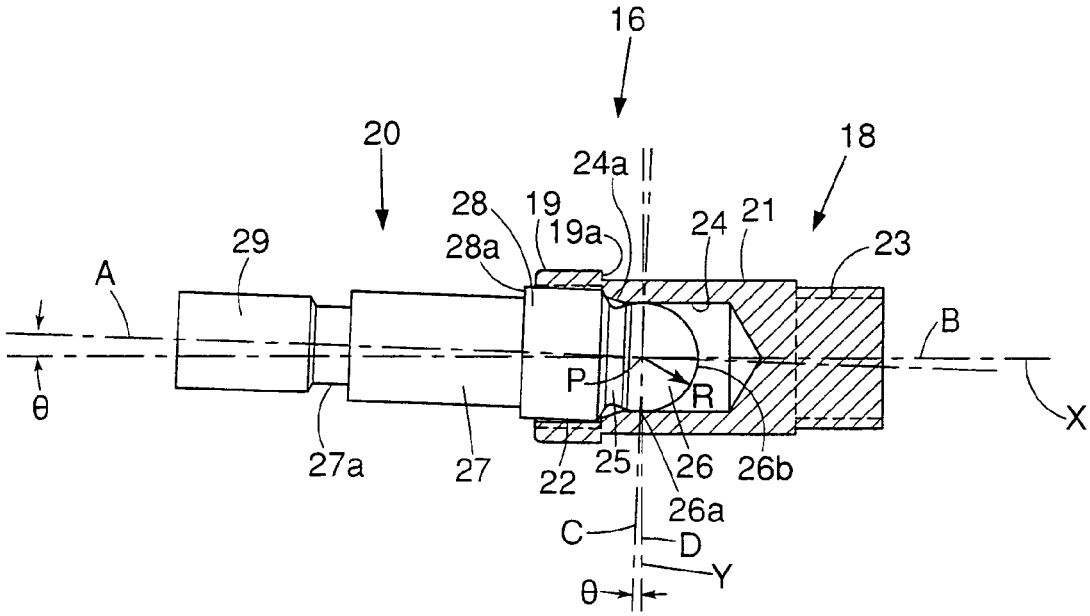
FIG. 5 is a side view of a joint engaged in a manner that can compensate for misalignment.

Typically, when assembled for use, the stick portions 12 and 14 of cue stick 10 are in alignment with each other along the longitudinal axis X. Preferably, the coupling rod 20 and the sleeve 18 are secured to stick portions 12 and 14 in a manner where the axis A of the coupling rod 20 and the axis B of the sleeve 18 are aligned along axis X. However, due to manufacturing methods and tolerances, sometimes the coupling rod 20 and sleeve 18 are secured to stick portions 12 and 14 in a manner where one or both of the axes A and B are misaligned with the axis X of cue stick 10. FIG. 5 depicts an example where the axis A of coupling rod 20 is misaligned with respect to axis X of cue stick 10 and the axis B of sleeve 18 by an angle θ, with the stick portions 12 and 14 being omitted for clarity. Note that the axis B of sleeve 18 is shown to be positioned in alignment with axis Y for simplicity.

The joint 16 can compensate for such misalignment as follows. During assembly of the stick portions 12 and 14, the locating tip 26 and the male threaded region 28 of the coupling rod 20 are inserted into and engage the bore 24 and female threaded region 22 of the sleeve 18. The stick portions 12 and 14 are rotated to tighten the male threaded region 28 within the female threaded region 22. Due to the misalignment, the face 30*a* of the collar on stick portion 12 can be tilted relative to the face 14*a* of the second stick portion 14. As the stick portions 12 and 14 come together, the face 30*a* of the collar 30 on stick portion 12 and the face 14*a* of stick portion 14, can move relative to each other to attempt to have full or flat contact between the faces 30*a* and 14*a*. This can move or push the coupling rod 22 and the sleeve 18 into misalignment to the angle θ as shown in FIG. 5. As the misalignment occurs, the pivot structure 26*a* of the locating tip 26 can pivot or rotate within the bore 24 about pivot point P on the rounded or curved surfaces of pivot structure 26*a* by an amount equal to the angle θ.

The spherical shape of the spherical portion 26*b* at the pivot structure 26*a* can allow the locating tip 26 to pivot or rotate while maintaining annular engagement with the bore 24 along the lateral axis D of sleeve 18. Axis D is shown in FIG. 5 to coincide with lateral axis Y of cue stick 10 which is perpendicular to longitudinal axis X. The spherical portion 26*b* can rotate or roll in place so that the spherical portion 26*b* can simultaneously roll and slide within bore 24, and can form a ball-type joint. In addition, the spherical portion 26*b* can roll as the spherical portion 26*b* moves or slides deeper into the bore 24. As the pivoting occurs, the lateral axis C of the coupling rod 20 that extends through the pivot point P becomes misaligned with the lateral axis D of sleeve 18 by an amount shown by the angle θ. Pivoting of the locating tip 26 within bore 24 can allow pivoting of the coupling rod 20 and sleeve 18 relative to each other such that the axis A of the coupling rod 20 can move to the angle θ relative to the axis B of sleeve 18. The threaded regions 28 and 22 can be provided with sufficient clearance relative to each other to allow such pivoting when engaged. In this manner, the stick portions 12 and 14 of the cue stick 10 can be secured together in axial alignment along axis X in cases where the coupling rod 20 and/or the sleeve 18 are misaligned relative to the axis X of the stick portions 12 and 14.

The compensation for misalignment by joint 16 can allow the stick portions 12 and 14 to be made separately and at different manufacturing locations since tolerances can be increased. As a result, stick portions 12 and 14 can be interchangeable with other stick portions 12 and 14. For example, a user can have one stick portion 12 or 14, and several different stick portions 12 or 14, having different properties, that can be selectively chosen for assembly together, depending upon the situation at hand. Such different properties can include different lengths, stiffness, etc. In addition, if a user damages one stick portion 12 or 14, a replacement stick portion can be purchased without concern that there will be a problem of misalignment of the stick portions when assembled for use.

Figure 6:
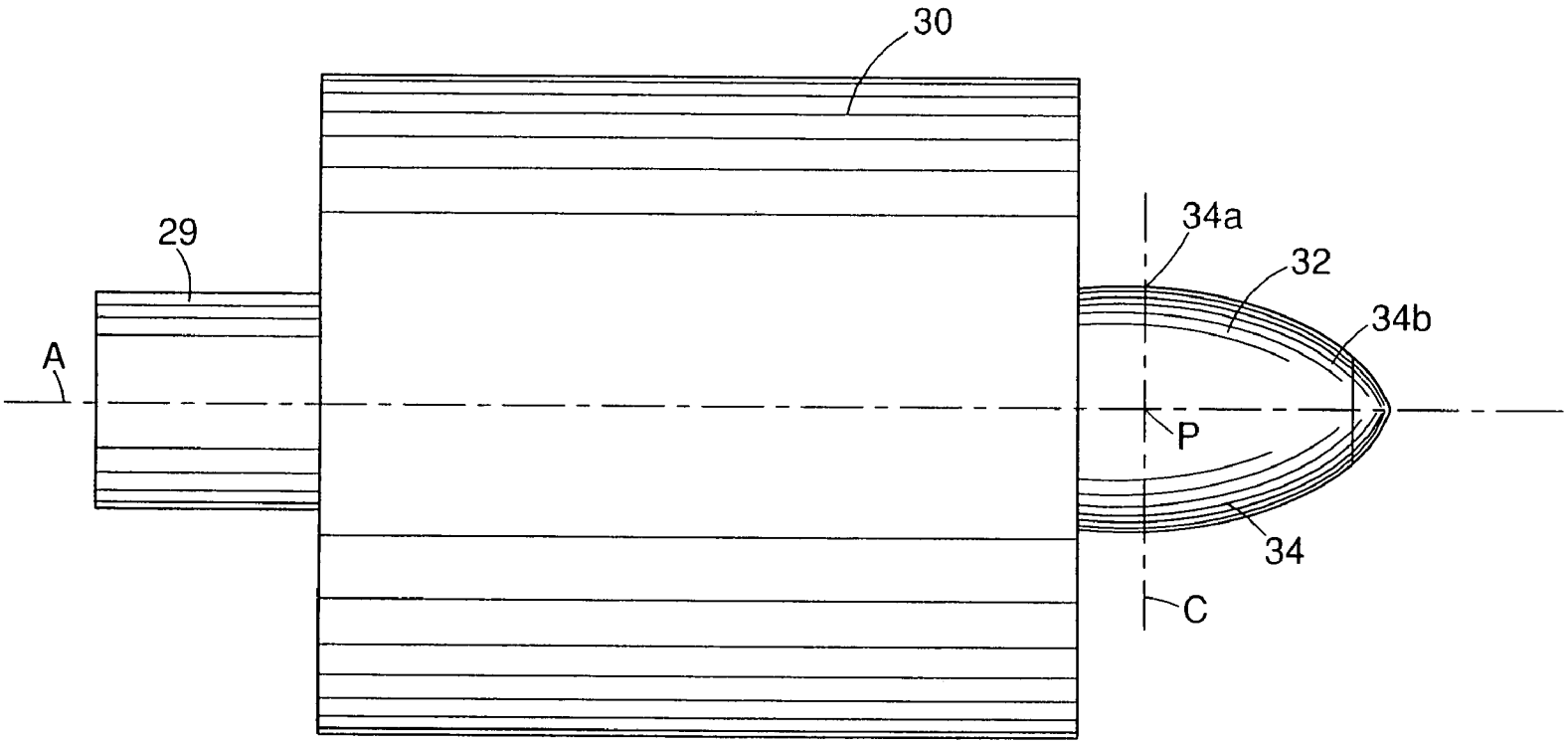
FIG. 6 is a side view of another embodiment of a coupling rod surrounded by a collar in a coupling rod/collar assembly.
Figure 7:
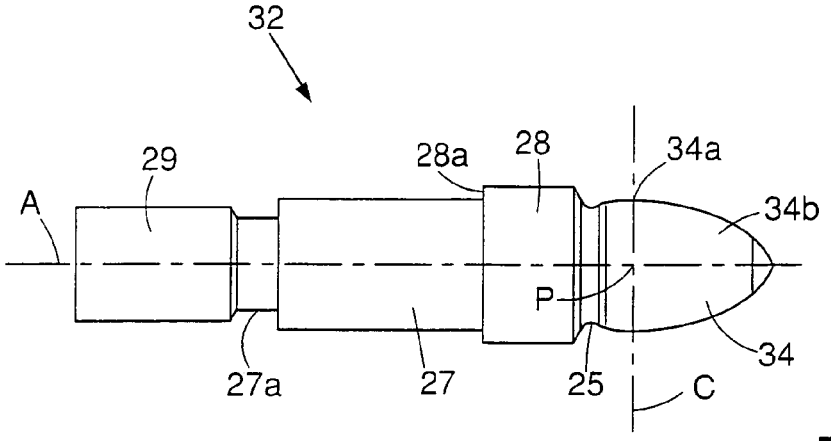
FIG. 7 is a side view of the embodiment of the coupling rod of FIG. 6.

FIGS. 6-12 depict other suitable coupling rods which can be substituted for the coupling rod 20 in joint 16 of the sports stick or cue stick 10. Referring to FIGS. 6 and 7, coupling rod 32 differs from coupling rod 20 in that coupling rod 32 can have a locating tip 34 which has a rounded bullet shaped distal end or tip 34*b*. The locating tip 34 can have a pivot structure 34*a* formed by the curved surfaces in the region on and near axis C. The locating tip 34 and the pivot structure 34*a* can be shaped to provide annular engagement with the bore 24 of sleeve 18 and pivoting, rotating or rolling therein about pivot point P. The locating tip 34 can have a diameter or width at axis C of about 0.32 inches, and the longitudinally curving surfaces of the locating tip 34 can have a radius of about 0.5 inches. The locating tip 34 can extend from the male threaded region 28 about 0.49 inches.

Figure 8:
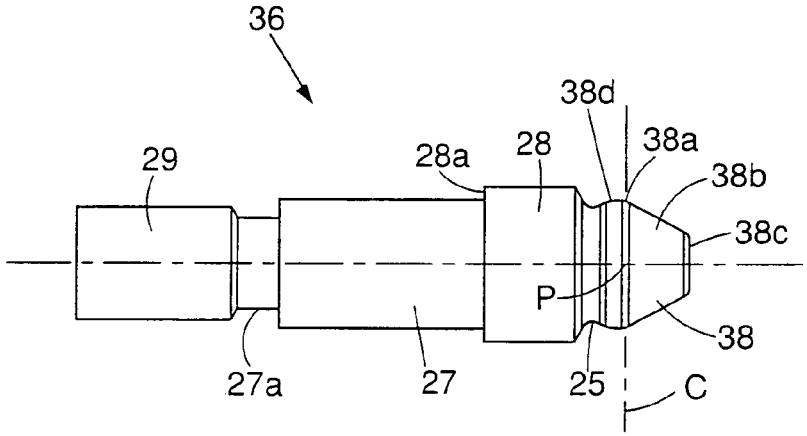
FIGS. 8-12 are side views of other embodiments of coupling rods.

Referring to FIG. 8, coupling rod 36 differs from coupling rod 20 in that the locating tip 38 can have a tapered or angled conical portion 38*b* which terminates in a flat distal end 38*c*. A rounded portion 38*d* can curve into the neck 25. The pivot structure 38*a* can be formed by the narrow transition region between the tapered portion 38*b* and the rounded portion 38*d*. This transition region can be a rounded ridge which can provide annular engagement with the bore 24 of sleeve 18 and pivoting, rotating or rolling therein about pivot point P. The locating tip 38 can have a diameter or width along axis C of about 0.32 inches. The tapered portion 38*b* can be tapered at about a 28° angle and the rounded portion 38*d* can have about a 0.16 inch radius. The locating tip 38 can extend from the male threaded region about 0.28 inches.

Figure 9:
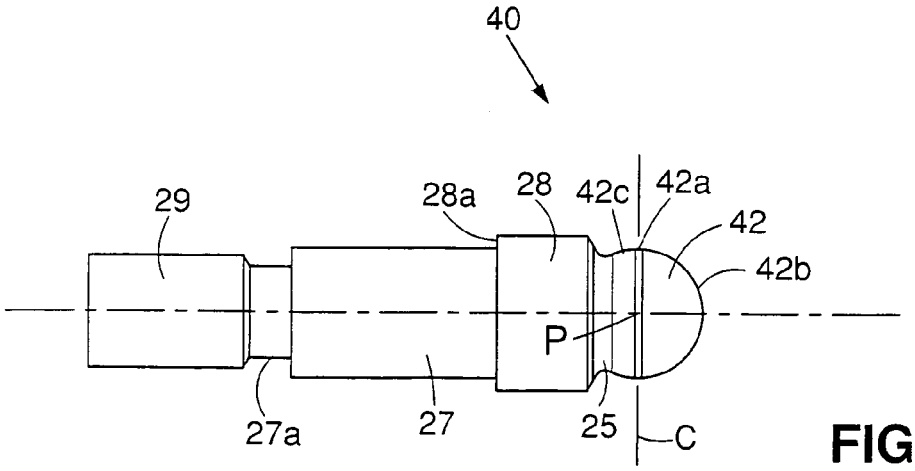

Referring to FIG. 9, coupling rod 40 differs from coupling rod 20 in that the locating tip 42 has a rounded distal end 42*b* which has a larger radius than the radius that is at the pivot structure 42*a* and axis C. The diameter at axis C can be about 0.32 inches (radius of 0.16 inches). The radius of the rounded distal end 42*b* can be about 0.2 inches. There can be a rounded transition portion between the pivot structure 42*a* and the neck 25 which can have a radius of about 0.09 inches. The pivot structure 42*a* can be formed by a narrow rounded ridge region formed by portions 42*b* and 42*c* which can provide annular engagement with the bore 24 of sleeve 18 and pivoting, rotating or rolling therein about pivot point P. The pivot structure 42*a* can have a diameter along axis C of about 0.32 inches (a radius of about 0.16 inches) which can be, for example, about 0.02 inches long. The locating tip 42 can extend from the male threaded region 28 about 0.28 inches.

Figure 10:
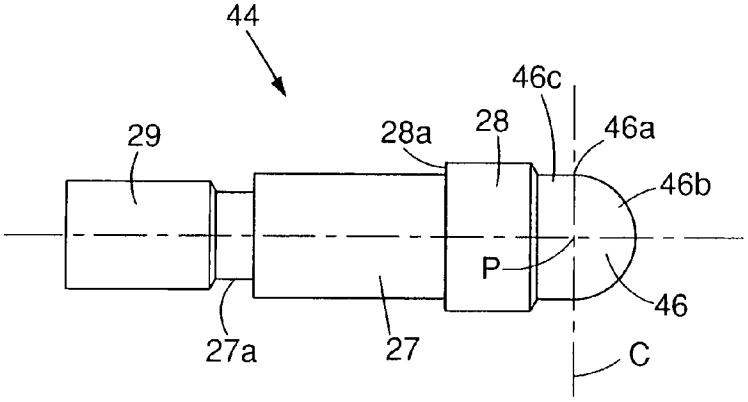

Referring to FIG. 10, coupling rod 44 differs from coupling rod 20 in that locating tip 46 can have a rounded distal end portion 46*b* which can be extended from, connected to or transition to a constant diameter portion 46*c* at axis C. The pivot structure 46*a* can be located at the transition point of the curved surface which can provide annular engagement with the bore 24 of sleeve 18 and pivoting, rotating or rolling therein about pivot point P. The rounded distal end portion 46*b* can have a radius of about 0.16 inches (diameter of about 0.32 inches) at axis C so that the constant diameter portion 46*c* also can have a diameter of about 0.32 inches. The length of the constant diameter portion 46*c* can be sized so that the pivot structure 46*a* engages the bore 24 of sleeve 18 just beyond the tapered entrance 24*a*, thereby allowing pivoting. The constant diameter portion 46*c* can be about 0.1 inches long.

Figure 11:
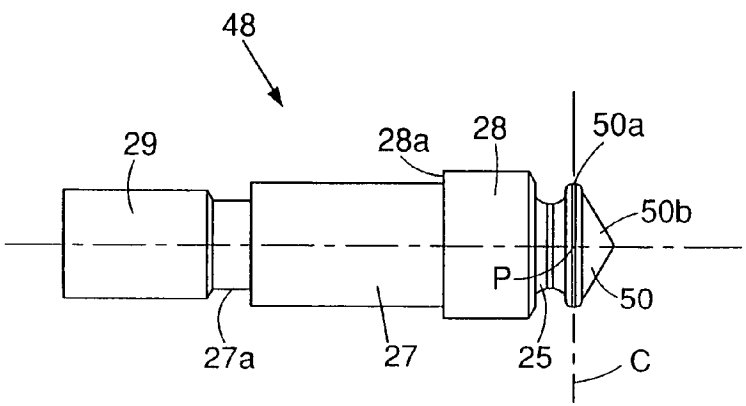

Referring to FIG. 11, coupling rod 48 differs from coupling rod 36 in that locating tip 50 can have a distal end 50*b* that tapers or angles to a conical point. The pivot structure 50*a* can be at the beginning or outer diameter of the taper and can be on a ridge centered about axis C. The ridge of the pivot structure 50*a* can be rounded which can provide annular engagement with the bore 24 of sleeve 18 and pivoting, rotating or rolling therein about pivot point P. The diameter of the pivot structure 50*a* at axis C can be about 0.32 inches and can have about a 0.02 inch radius curve on the edges of the ridge. The locating tip 50 can extend from the male threaded region 28 about 21 inches.

Figure 12:
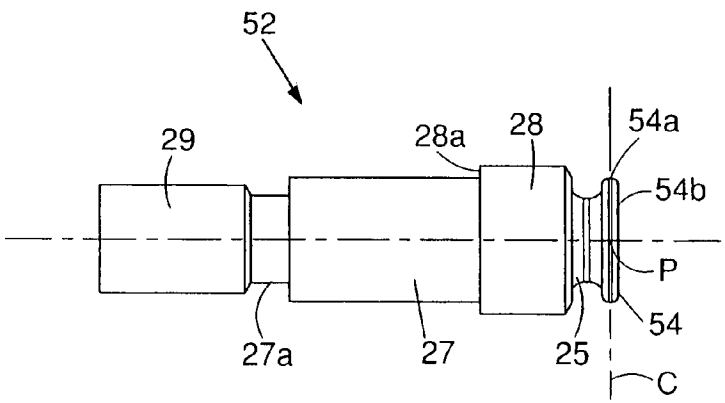

Referring to FIG. 12, coupling rod 52 differs from coupling rod 48 in that locating tip 54 can have a flat distal end 54*b*. As a result, locating tip 54 can be considered a narrow disc that extends from and can be connected to the male threaded region 28 by neck 25. The disc can form the pivot structure 54*a* and can have a rounded ridge with rounded edge surfaces to promote or allow pivoting, rotating or rolling within the bore 24 of sleeve 18 about pivot point P while providing annular engagement. The pivot structure 54*a* can be about 0.32 inches in diameter at axis C for a length of about 0.01 inches, and can have thickness of about 0.04 inches.

Figure 13:
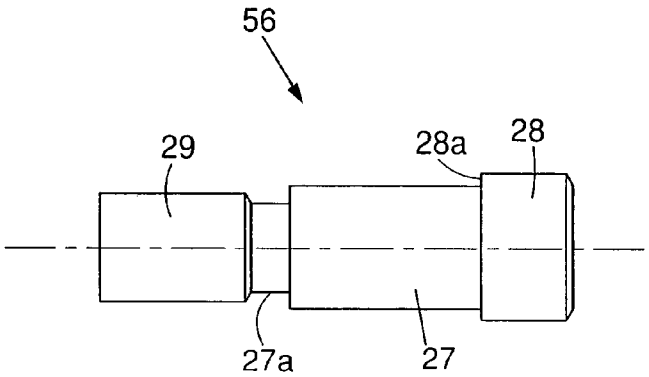
FIG. 13 is a side view of yet another embodiment of a coupling rod.

FIG. 13 depicts a coupling rod 56 which differs from coupling rod 20 in that there is no locating tip. The male threaded region 28 can engage the female threaded region 22 of sleeve 18 and the threaded regions 28 and 22 can be formed with enough clearance between the threads to allow slight lateral movement of the male threaded region 28 within the female threaded region 22 so that the stick portions 12 and 14 can tighten together in alignment if there is misalignment of the coupling rod 56 and sleeve 18.

Figure 14:
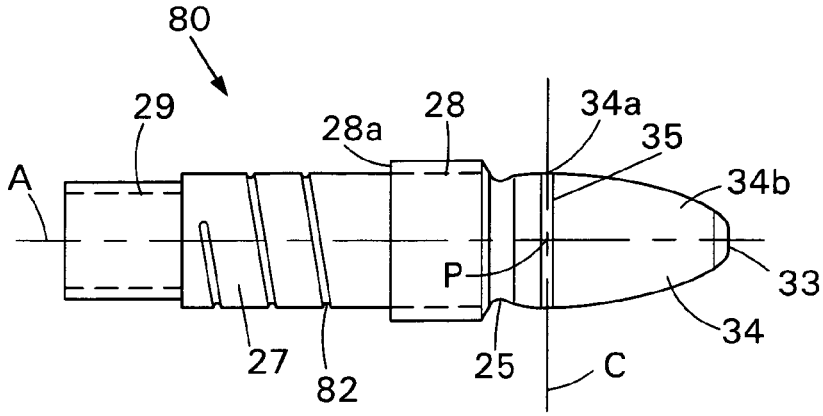
FIG. 14 is a side view of another embodiment of a coupling rod having a bullet shaped tip.

Referring to FIG. 14, coupling rod, pin or first joint member 80 differs from coupling rod 32 in that the rounded bullet shaped distal end or tip 34*b* can have a flattened nose 33. The pivot structure 34*a* can include an annular surface, ridge, or ring 35 extending around the surface of the locating tip 34. The annular surface 35 in some embodiments can have a flattened surface about 0.030 inches wide but can vary depending upon the situation at hand. In some embodiments, the annular surface 35 can be curved. Coupling rod 80 can be made without a neck 27*a*. In some embodiments, the locating tip 34 can have a diameter or width at axis C of about 0.3 inches, for example, 0.295/0.294 inches, the longitudinally curving surfaces at the locating tip 34 can have a radius of about 0.8 inches, and the locating tip 34 can extend from the male threaded region 28 about 0.56 inches. The flattened nose 33 can have a diameter of about 0.04 inches. The smooth outer diameter portion 27 can have a glue groove 82 which can spiral on the outer surface and can provide a stronger glue joint. It is understood that the dimensions can vary and the mating sleeve 18 can be dimensioned appropriately to accommodate the dimensions employed.

Figure 16:
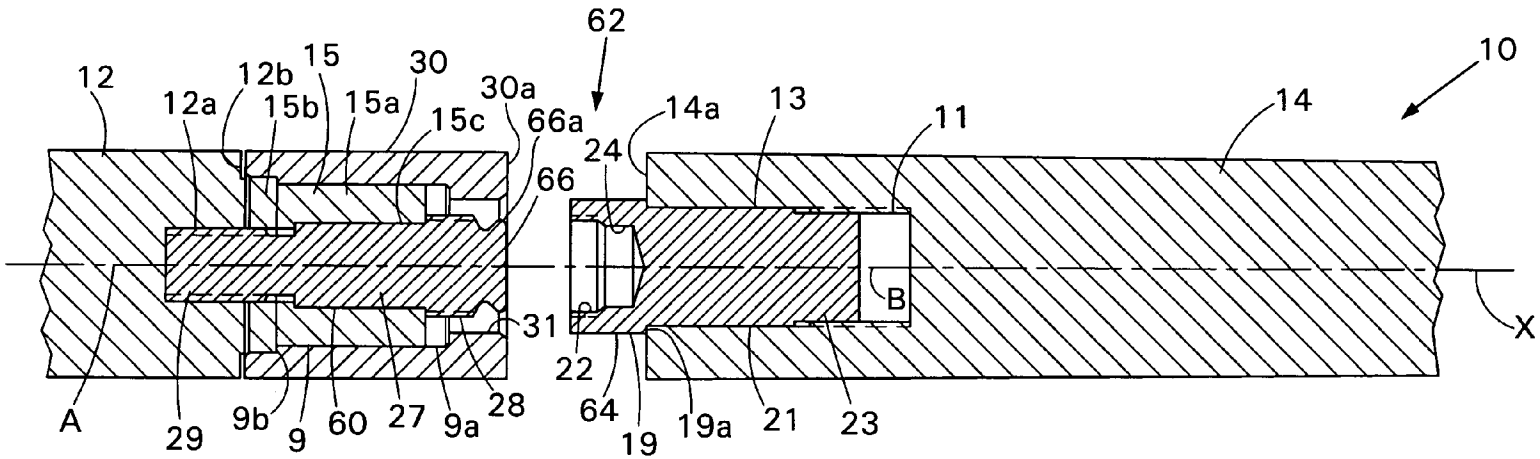
FIG. 16 is a sectional view of FIG. 15.
Figure 15:
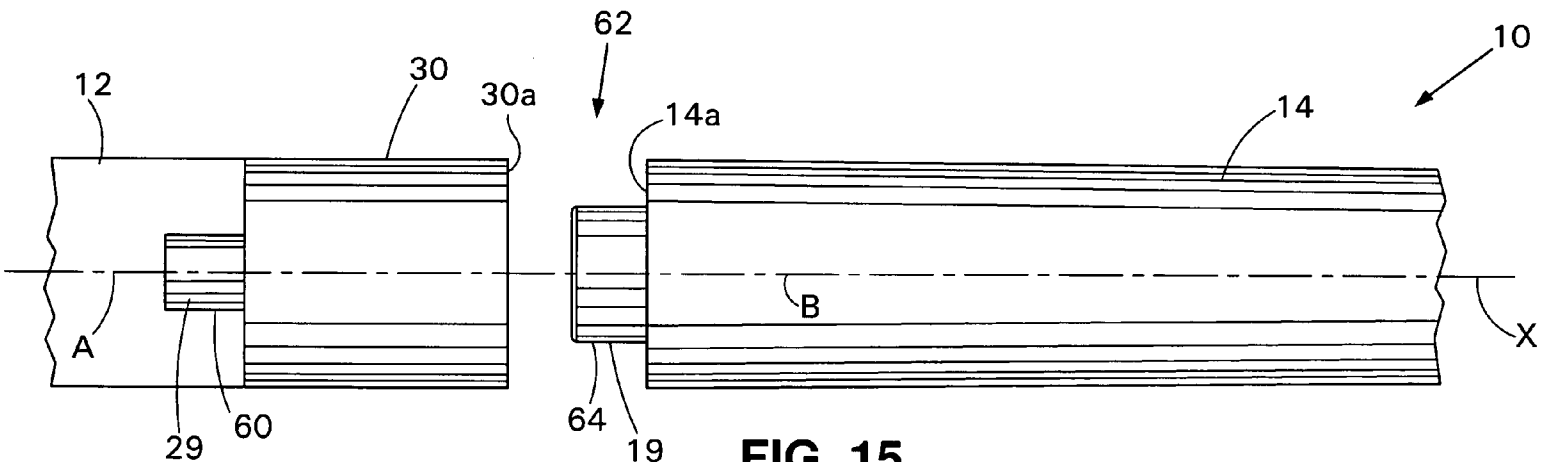
FIG. 15 is a side view of two stick portions including a hidden first joint member or coupling rod.

Referring to FIGS. 15 and 16, joint 62 is another embodiment of a joint for a sports stick such as a cue stick 10 in the present invention. Joint 62 differs from joint 16 in that it includes a coupling rod, pin or first joint member 60 secured to the first stick portion 12 and having a short locating tip 66 which can be surrounded and hidden by the collar 30, for example, when viewed from the side. The coupling rod 60 can engage an insert, sleeve or second joint member 64 secured to the second stick portion 14. The locating tip 66 can be below or flush with the end or face 30*a* of the collar 30, or can extend beyond the collar 30 a small amount and can be still visually or generally considered hidden when viewed from the side. The coupling rod 60 and the collar 30 can be secured together by a bushing 15 as an assembly.

Figure 17:
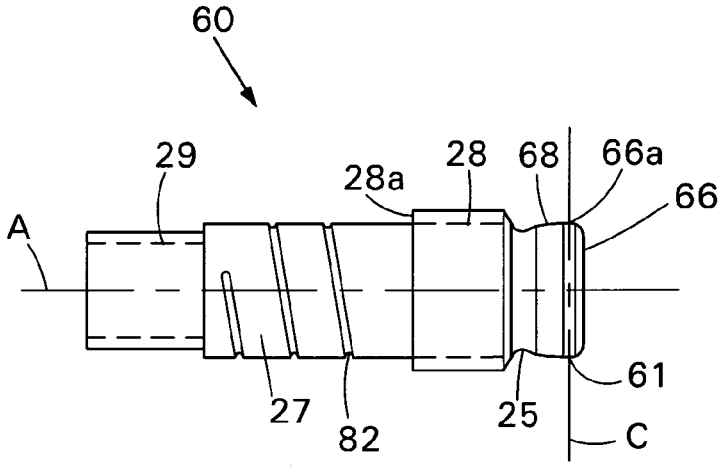
FIG. 17 is a side view of an embodiment of the coupling rod depicted in FIG. 16.
Figure 18:
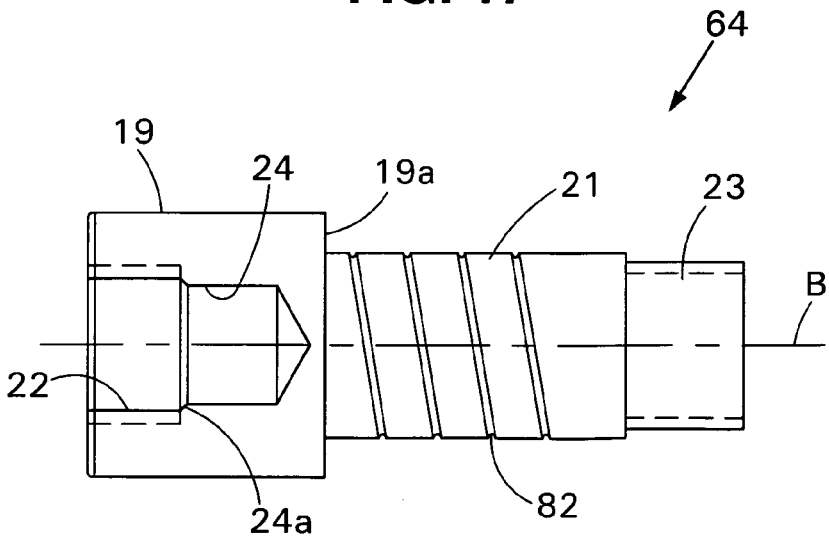
FIG. 18 is a side sectional view of an embodiment of the second joint member or sleeve depicted in FIG. 16.

FIGS. 17 and 18 depict embodiments for coupling rod 60 and sleeve 64. The locating tip 66 of coupling rod 60 can have a pivoting structure 66*a* that is connected to male threaded region 28 by a neck 25 and an inclined portion 68. A smooth outer diameter portion or region 27 and a secondary male threaded region 29 can extend from male threaded region 28. The smooth outer diameter portion 27 can include a glue groove 82. The pivot structure 66*a* can be centrally positioned about lateral axis C and pivot point P, and can have a smooth diameter 61 of about 0.3 inches, for example, 0.2990/0.2980 inches, with a short axial length, for example, about 0.03 inches long. The diameter 61 can have an annular surface or ring that is flat, or alternatively can be curved. The coupling rod 60 can be made without a neck 27*a*. The locating tip 66 and its pivot structure 66*a* can engage the bore 24 of sleeve 64 to provide strength to the assembled joint 62 while at the same time allowing pivoting about pivot point P when the threaded regions 28 and 22 engage each other, thereby compensating for any misalignment. The locating tip 66 can in some embodiments, provide increased joint strength that is 2-3 times greater than can be achieved by a coupling rod without a locating tip, for example, coupling rod 56 of FIG. 13. The threaded regions 28 and 22 can engage each other in a similar manner as previously discussed. Sleeve 64 can be similar to sleeve 18 but can have the female threaded region 22 and the bore 24 located within head 19 if the locating tip 66 of coupling rod 60 does not extend beyond the end or face 30*a* of the collar 30. Conversely, locating the female threaded region 22 and the bore 24 within the head 19, and axially beyond, outside or adjacent to the face 14*a* of stick portion 14, allows the coupling rod 60 to be hidden within and not extend beyond the collar 30. The head 19 can be generally annular and can enter the annular recess 31 in collar 30 for engagement with the hidden coupling rod 60. The locating tip 66 can extend into the sleeve 64 only within the head 19 of the sleeve 64, located outside the face 14*a* of the stick portion 14. In some embodiments, the entire head 19 can enter the annular recess 31. This can allow the face 30*a* of the collar 30 to engage the face 14*a* of the stick portion 14 when assembled. In some embodiments, bore 24 can have a diameter of about 0.3 inches, for example, 0.301/0.300 inches, and can terminate about 0.43 inches from the end face of head 19, The head 19 can have an outer diameter of about ⅝ inches, for example, 0.625/0.620 inches, and can be about 0.535 inches long. The outer diameter of the head 19 and/or the bore of the collar 30 can be dimensioned to engage the bore of the collar 30 to provide additional stability and/or for alignment or locating purposes. In some embodiments, other suitable coupling rods such as coupling rod 52 of FIG. 12 can be substituted for coupling rod 60 in joint 62. In some situations, the coupling rod 60 can extend slightly beyond the face 30*a* of collar 30. In such a situation, the bore 24 in the sleeve 64 can extend past or beyond the head 19 into region 21.

Figure 19:
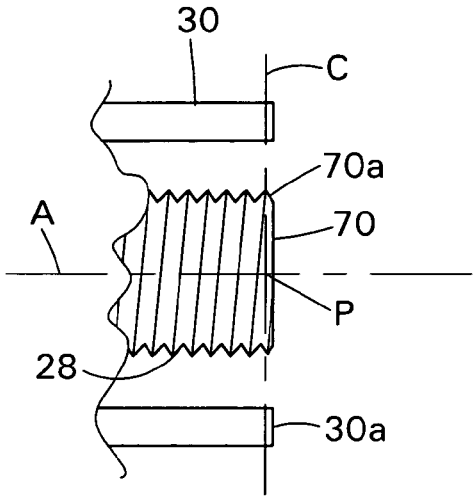
FIG. 19 is a side sectional view depicting a portion of another embodiment of a first joint member or coupling rod arrangement.

Referring to FIG. 19, the locating tip 66 of coupling rod 60 can be omitted such that the male threaded region 28 is positioned flush or close to flush with the end or face 30*a* of collar 30. The end 70 can extend into the sleeve only within the head 19 of the sleeve 64 located outside the face 14*a* of the stick portion 14. Depending upon the dimensions chosen, the male threaded region 28 can terminate before reaching the bore 24 of sleeve 64, or the distal end 70 of the male threaded region 28 can be sized or contoured for serving as a locating tip and pivoting structure positioned along lateral axis C and pivot point P. For example, the end 70 can have a bevelled surface 70*a*. In some embodiments, the mating threads 28 and 22 can be made with enough clearance or play to compensate for misalignment. Coupling rod 56 of FIG. 13 can also be employed in a hidden manner relative to collar 30.

Figure 20:
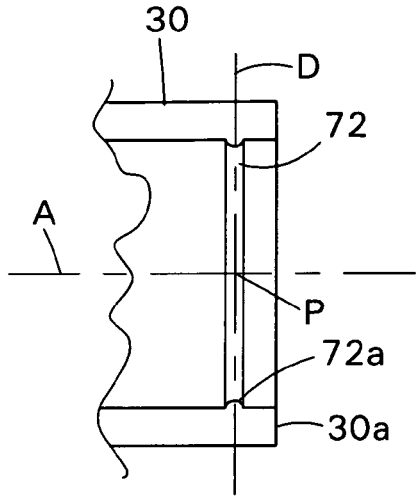
FIG. 20 is a side sectional view depicting a portion of a collar with a pivot structure.

Referring to FIG. 20, the collar 30 can have an internal pivot structure 72 positioned along a lateral axis D of the collar 30. The pivot structure 72 can be a narrow annular protrusion extending radially inwardly from the bore of the collar 30. The pivot structure 72 can have a short axial length which can engage the outer diameter of the head 19 of the sleeve, for example, sleeve 64, along an annular line of contact for pivoting about pivot point P, and compensating for misalignment. The pivot structure 72 can have either flat, rounded or curved contact or pivot surfaces 72*a*. The pivot structure 72 can be integrally formed in the collar 30, or can be a separate component that is positioned within collar 30. In some embodiments, a ring can be employed as the pivot structure 72, such as an "O" ring. In other embodiments, the pivot structure 72 can be formed by a series of protrusions positioned in an annular pattern circumferentially within the bore of the collar 30. When employing a collar 30 having a pivot structure 72, a coupling rod such as seen in FIGS. 13 and 19 can be used, where the coupling rod does not require a locating tip, since locating and alignment can be accomplished by engagement of the head of the sleeve with the bore of the collar 30. In some embodiments, a coupling rod with a locating tip can be employed.

Figure 21:
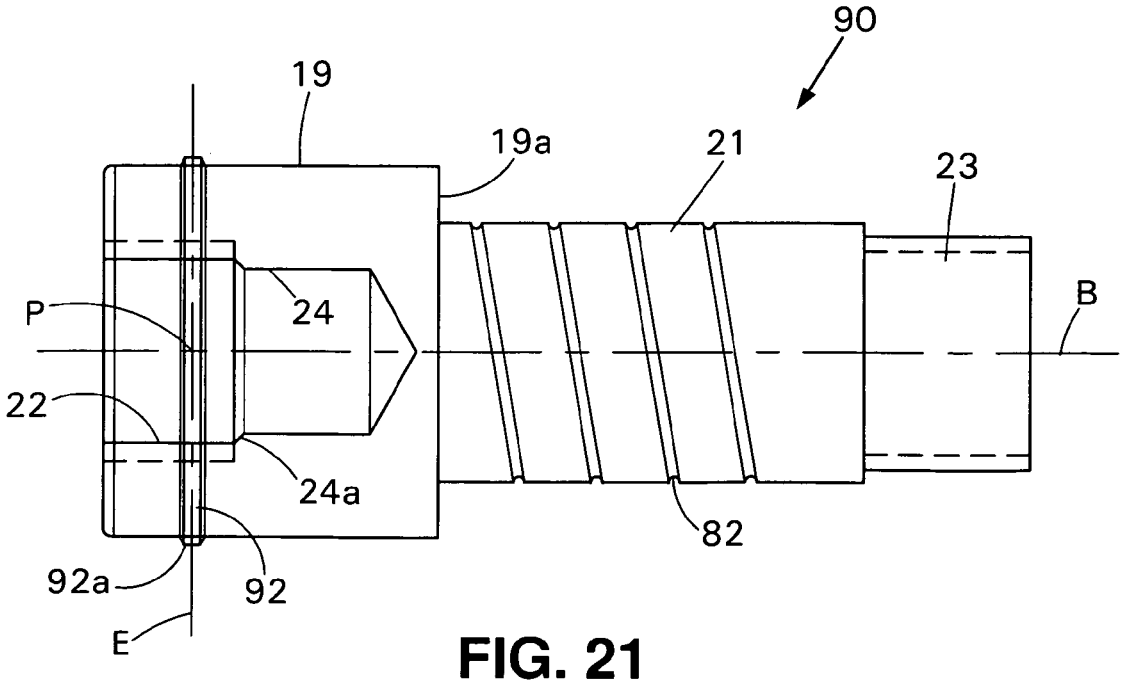
FIG. 21 is a side view of another embodiment of the second joint member or sleeve.

Referring to FIG. 21, insert, sleeve or second joint member 90 is an embodiment of a sleeve that can be employed and differs from sleeve 64 in that sleeve 90 can have a pivot structure 92 positioned along a lateral axis E of the sleeve 90. The pivot structure 92 can be a narrow annular protrusion extending circumferentially around the outer diameter of the head 19. The axial length of the pivot structure 92 along axis B can be short, for engaging the inner bore of the collar 30 along an annular line of contact for pivoting about pivot point P, and compensating for misalignment. The pivot structure 92 can have a flat contact or pivot surface 92*a*, as shown, or alternatively can be curved or rounded. When employing sleeve 90, a coupling rod such as seen in FIGS. 13 and 19 can be used, where the coupling rod does not require a locating tip, since locating and alignment can be accomplished by engagement of the head 19 of the sleeve 90 with the bore of the collar 30. In some embodiments, if the mating coupling rod does not have a locating tip, the bore 24 can be omitted and the coupling rod only engages the threaded region 22. The pivot structure 92 can be integrally formed with the head 19, but alternatively, can be a separate component that is positioned around the head 19. In some embodiments, a ring can be employed as the pivot structure 92, such as an "O" ring. In other embodiments, the pivot structure 92 can be formed by a series of protrusions positioned in an annular pattern circumferentially around the head 19.

Coupling rods which extend beyond and are not hidden by the collar 30 can also be employed with sleeves having a head 19 that engages the bore of the collar 30. Often at least a portion of the male threaded region 28 is surrounded by the collar 30. In some embodiments, a coupling rod with a locating tip can be employed.

While this invention has been particularly shown and described with references to example embodiments thereof it will be understood by those skilled in the at that various changes in form and details may be made therein without departing from the scope of the invention encompassed by the appended claims.

For example, it is understood that although particular examples of dimensions have been described, it is understood that dimensions can vary depending upon the situation at hand. In addition, the locating tips can be made to be resilient, so that bending or deflection of the locating tip can compensate for misalignment. Various features can be combined or omitted. The joint in the present invention can be used in other sports sticks that can be assembled from multiple pieces including golf clubs. Other embodiments of the joint in the present invention can include applications such as tent poles, sticks for paint rollers, etc. It is understood that a stick in the present invention can have more than two stick portions that can be assembled together.

What is claimed is:

1. A cue stick portion comprising:

a pin secured to a stick portion, the pin having a male threaded region for engaging a mating stick portion and a distal end, the distal end of the pin including a pivot structure extending from the male threaded region, the pivot structure comprising a smooth diameter having a short axial length spaced apart from the male threaded region by a narrowed neck, forming an annular pivot structure; and a collar concentrically surrounding the male threaded region and the distal end of the pin, the pin being hidden within the collar when viewed from the side, and the distal end of the pin being generally flush with a distal end of the collar.

2. The stick portion of claim 1 in which the collar forms an annular recess around the pin.

3. The stick portion of claim 1 in which the collar has a bore with a pivot structure extending radially inwardly.

4. A joint for a cue stick comprising:

a first joint member including a pin with a joint securing male threaded region and a distal end, and a collar concentrically surrounding the male threaded region and the distal end of the pin, being hidden within the collar when viewed from the side, and the distal end of the pin being generally flush with a distal end of the collar; and a second joint member being configured and having a hole for receiving the pin, the hole having a joint securing female threaded region for engaging the joint securing male threaded region of the first joint member for coupling the first and second joint members together, the first joint member including an annular recess between the pin and the collar, the second joint member having a protruding head that is insertable within the annular recess of the first joint member, the distal end of the pin including a pivot structure extending from the male threaded region, and the hole of the second joint member including a bore for receiving the pivot structure, the pivot structure configured to engage the bore and pivot against the bore such that the first joint member is capable of pivoting about the pivot structure to compensate for misalignment of the first and second joint members, the pivot structure having a close fit with the bore and having a pivot surface that is shaped for pivoting within a constant diameter portion of the bore with a narrow annular region of engagement with the bore within the constant diameter portion.

5. The joint of claim 4 in which the first and second joint members are capable of engaging together within about four turns relative to each other.

6. The joint of claim 5 in which the first and second joint members are capable of engaging together within about one turn relative to each other.

7. A cue stick comprising:

a first stick portion;

a first joint member secured to the first stick portion, the first joint member including a pin with a joint securing male threaded region and a distal end, the distal end of the pin including a pivot structure extending from the male threaded region, the pivot structure comprising a smooth diameter having a short axial length spaced apart from the male threaded region by a narrowed neck, forming an annular pivot structure, and a collar concentrically surrounding the male threaded region and the distal end of the pin, the pin being hidden within the collar when viewed from the side and the distal end of the pin being generally flush with a distal end of the collar;

a second stick portion; and a second joint member secured to the second stick portion, the second joint member being configured and having a hole for receiving the pin, the hole having a joint securing female threaded region for engaging the joint securing male threaded region of the first joint member for coupling the first and second joint members together.

8. A joint for a cue stick comprising:

a first joint member including a pin with a joint securing male threaded region and a distal end, and a collar concentrically surrounding the male threaded region and the distal end of the pin, the pin being hidden within the collar when viewed from the side; and a second joint member being configured and having a hole for receiving the pin, the hole having a joint securing female threaded region for engaging the joint securing male threaded region of the first joint member for coupling the first and second joint members together, the collar having a bore with a pivot structure extending radially inwardly to allow pivoting of the joint members to compensate for misalignment.

* * * * *